US009345275B2

(12) United States Patent
Albin et al.

(10) Patent No.: US 9,345,275 B2
(45) Date of Patent: May 24, 2016

(54) LOWER BODY GARMENT WITH ELASTICITY-REDUCING PANEL

(75) Inventors: Shaun Albin, Lake Oswego, OR (US); Alexander J. Dedman, Portland, OR (US); Daniel B. Peters, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 177 days.

(21) Appl. No.: 13/362,634

(22) Filed: Jan. 31, 2012

(65) Prior Publication Data

US 2012/0210487 A1 Aug. 23, 2012

Related U.S. Application Data

(60) Provisional application No. 61/444,661, filed on Feb. 18, 2011.

(51) Int. Cl.
*A41D 1/08* (2006.01)
*A41D 13/00* (2006.01)

(52) U.S. Cl.
CPC ..... *A41D 1/08* (2013.01); *A41D 13/0015* (2013.01)

(58) Field of Classification Search
USPC ..... 2/69, 22, 23, 227; 66/177; 482/124; 602/62
See application file for complete search history.

(56) References Cited

U.S. PATENT DOCUMENTS

| | | | | |
|---|---|---|---|---|
| 4,089,064 | A | 5/1978 | Chandler, Jr. | |
| 4,216,547 | A | 8/1980 | Picchione | |
| D279,830 | S | 7/1985 | Setzler | |
| 4,625,336 | A | 12/1986 | Derderian | |
| 4,670,913 | A | 6/1987 | Morell et al. | |
| 5,201,074 | A | 4/1993 | Dicker | |
| 5,263,923 | A | 11/1993 | Fujimoto | |
| 5,367,708 | A | 11/1994 | Fujimoto | |
| 6,047,406 | A | 4/2000 | Dicker et al. | |
| 6,186,970 | B1 | 2/2001 | Fujii et al. | |
| 6,401,497 | B1 | 6/2002 | Nishiyama et al. | |
| D481,523 | S * | 11/2003 | Hujii et al. | D2/742 |
| 6,874,337 | B2 | 4/2005 | Uno et al. | |
| D513,830 | S * | 1/2006 | Ota et al. | D2/731 |
| 7,074,204 | B2 | 7/2006 | Fujii et al. | |
| 7,229,390 | B2 | 6/2007 | Fujii et al. | |
| 7,516,498 | B2 | 4/2009 | Torry | |
| 7,526,929 | B2 | 5/2009 | Takamoto et al. | |
| 7,631,367 | B2 | 12/2009 | Caillibotte et al. | |

(Continued)

FOREIGN PATENT DOCUMENTS

| | | |
|---|---|---|
| CN | 1298282 | 6/2001 |
| CN | 1806706 | 7/2006 |

(Continued)

OTHER PUBLICATIONS

International Search Report and Written Opinion in PCT/US2012/025399 dated May 8, 2012.

(Continued)

*Primary Examiner* — Andrew W Collins
(74) *Attorney, Agent, or Firm* — Banner & Witcoff, Ltd.

(57) ABSTRACT

A garment may be formed from a stretchable material. Various portions of the garment may contain imprinted ink. Elasticity of the garment fabric is reduced in the regions onto which the ink has been printed, thereby providing a support and/or a feeling of support to certain muscles and/or muscle groups.

11 Claims, 16 Drawing Sheets

(56) References Cited

U.S. PATENT DOCUMENTS

| | | | | |
|---|---|---|---|---|
| 7,636,950 | B2 * | 12/2009 | Melhart et al. | 2/69 |
| 7,730,552 | B2 | 6/2010 | Ota et al. | |
| 7,814,576 | B2 | 10/2010 | Nakazawa | |
| 7,861,319 | B2 | 1/2011 | Torry | |
| 7,886,367 | B2 * | 2/2011 | Chapuis et al. | 2/69 |
| 7,945,970 | B2 * | 5/2011 | Belluye et al. | 2/69 |
| 8,296,864 | B2 * | 10/2012 | Torry | 2/69 |
| 8,533,864 | B1 * | 9/2013 | Kostrzewski | 2/69 |
| 2003/0028952 | A1 | 2/2003 | Fujii et al. | |
| 2004/0107479 | A1 * | 6/2004 | Dicker et al. | 2/227 |
| 2004/0111781 | A1 | 6/2004 | Miyake et al. | |
| 2006/0169004 | A1 | 8/2006 | Belluye et al. | |
| 2007/0074328 | A1 | 4/2007 | Melhart et al. | |
| 2007/0214541 | A1 | 9/2007 | Kawasaki et al. | |
| 2008/0083055 | A1 | 4/2008 | Onda | |
| 2008/0295216 | A1 | 12/2008 | Nordstrom et al. | |
| 2008/0295230 | A1 | 12/2008 | Wright et al. | |
| 2009/0038047 | A1 * | 2/2009 | Di Lorenzo | 2/67 |
| 2009/0133181 | A1 | 5/2009 | Nordstrom et al. | |
| 2009/0172858 | A1 | 7/2009 | Oya et al. | |
| 2010/0011479 | A1 * | 1/2010 | Onoda et al. | 2/67 |
| 2010/0043114 | A1 | 2/2010 | Caillibotte et al. | |
| 2010/0077527 | A1 | 4/2010 | Lee et al. | |
| 2010/0107299 | A1 | 5/2010 | Ota et al. | |
| 2010/0130903 | A1 | 5/2010 | Rock | |
| 2010/0299799 | A1 | 12/2010 | Belluye et al. | |
| 2012/0174282 | A1 * | 7/2012 | Newton et al. | 2/69 |

FOREIGN PATENT DOCUMENTS

| | | |
|---|---|---|
| CN | 101056551 A | 10/2007 |
| EP | 1563748 | 8/2005 |
| JP | 9149959 | 6/1997 |
| JP | 10110306 | 4/1998 |
| JP | 2001214303 | 8/2001 |
| JP | 2002220708 | 8/2002 |
| JP | 2003293203 | 10/2003 |
| JP | 2006219778 | 8/2006 |
| JP | 200723465 | 2/2007 |
| JP | 2009293145 | 12/2009 |
| WO | 2006032096 | 3/2006 |
| WO | 2006069308 | 6/2006 |

OTHER PUBLICATIONS

The First Office Action in CN201280019139X dated May 29, 2014, with English translation.

* cited by examiner

LOWER BODY GARMENT WITH ELASTICITY-REDUCING PANEL

CROSS-REFERENCE TO RELATED APPLICATIONS

This application claims priority of U.S. provisional patent application 61/444,661, filed Feb. 18, 2011, and titled "Garment," which application in its entirety is incorporated by reference herein.

BACKGROUND

Running, jogging and other forms of exercise can result in a participant experiencing at least some degree of fatigue. This fatigue can take both physical and mental forms. Physically, a person's muscles can become tired and/or sore. Mentally, some forms of exercise can be tedious, which tedium can be exacerbated if a person is experiencing discomfort. Providing additional support to fatigued muscles can help reduce physical fatigue. Providing a feeling of support to fatigued muscles can help to reduce mental fatigue.

SUMMARY

This Summary is provided to introduce a selection of concepts in a simplified form that are further described below in the Detailed Description. This Summary is not intended to identify key features or essential features of the invention.

In at least some embodiments, a garment may be formed from a stretchable material. Various portions of the garment may contain imprinted ink. Elasticity of the garment fabric is reduced in the regions onto which the ink has been printed, thereby providing support and/or a feeling of support to certain muscles and/or muscle groups. In some embodiments, the garment can be a garment intended for wear by a runner or jogger.

In some embodiments, a garment can include at least one stretchable fabric element and a first elasticity-reducing panel. The garment may be configured for wear by an individual, and the first elasticity-reducing panel may comprise a first pattern imprinted onto a first portion of the at least one stretchable fabric element. The first pattern may comprises lines. Portions of lines in an interior region of the first pattern may have a thickness less than a thickness of line portions in peripheral regions of the first pattern.

In some embodiments, a garment may comprise a stretch fabric lower body garment and a plurality of elasticity-reducing panels. At least a portion of the elasticity-reducing panels may be located in thigh regions of the garment. Each of the panels may comprise a pattern of ink lines imprinted onto the stretch fabric. Each of the panels may expose a substantial portion of the stretch fabric within the boundaries of the imprinted pattern.

Additional embodiments are described below.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

In at least some embodiments, a garment can comprise a stretchable fabric and be configured for wear as a lower body garment. As but one example, such a lower body garment could be intended for wear by a runner or jogger. One or more regions of the garment can include areas in which the elasticity of the garment fabric has been reduced. In particular, those regions can include imprinted patterns. In those regions, the elasticity of fabric portions having an applied pattern is reduced. This reduction of elasticity in selected portions of the garment fabric provides support and/or a feeling of support to certain muscles and/or muscle groups.

Figure 1A:
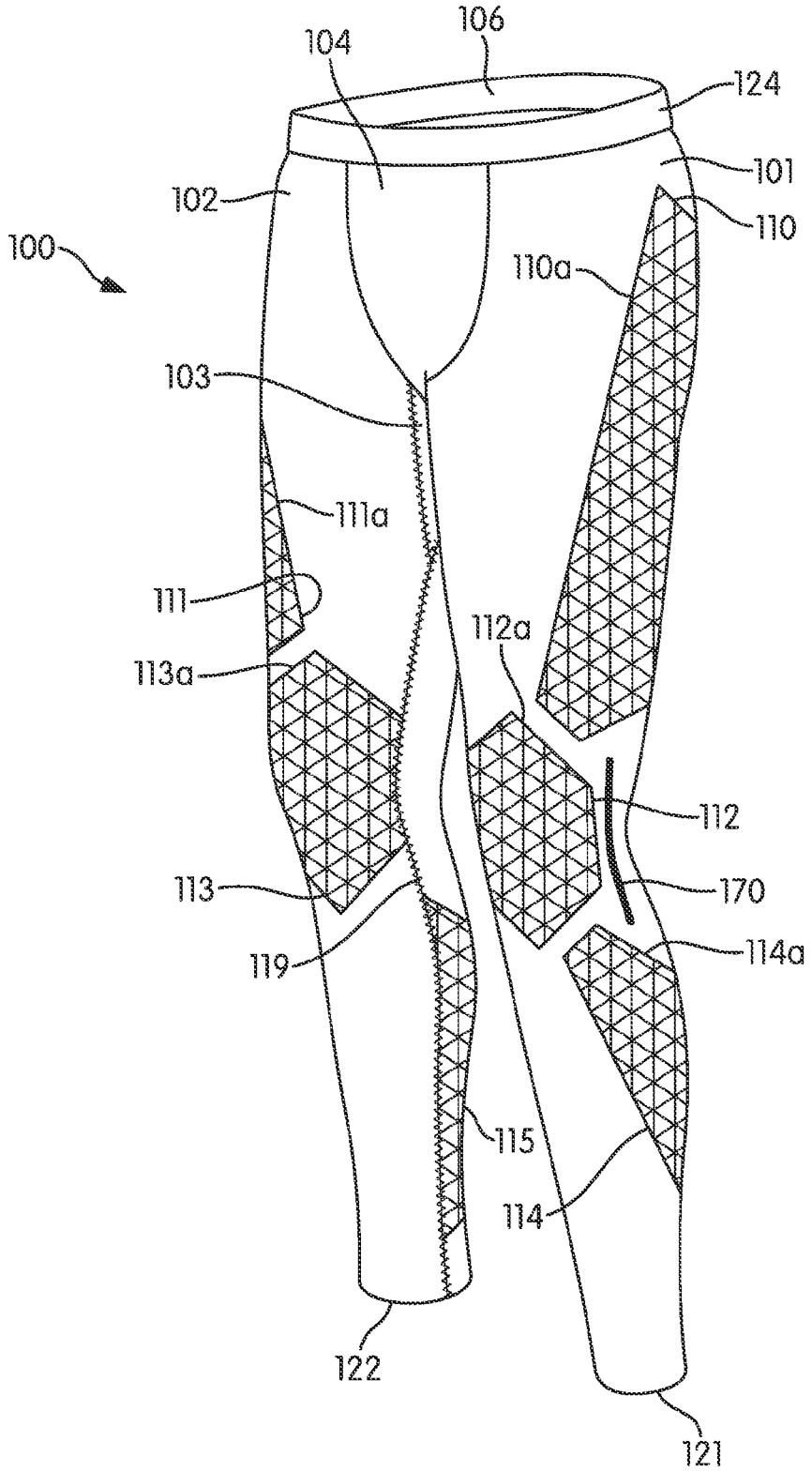
FIGS. 1A and 1B are front and rear views, respectively, of a garment according to some embodiments.
Figure 1B:
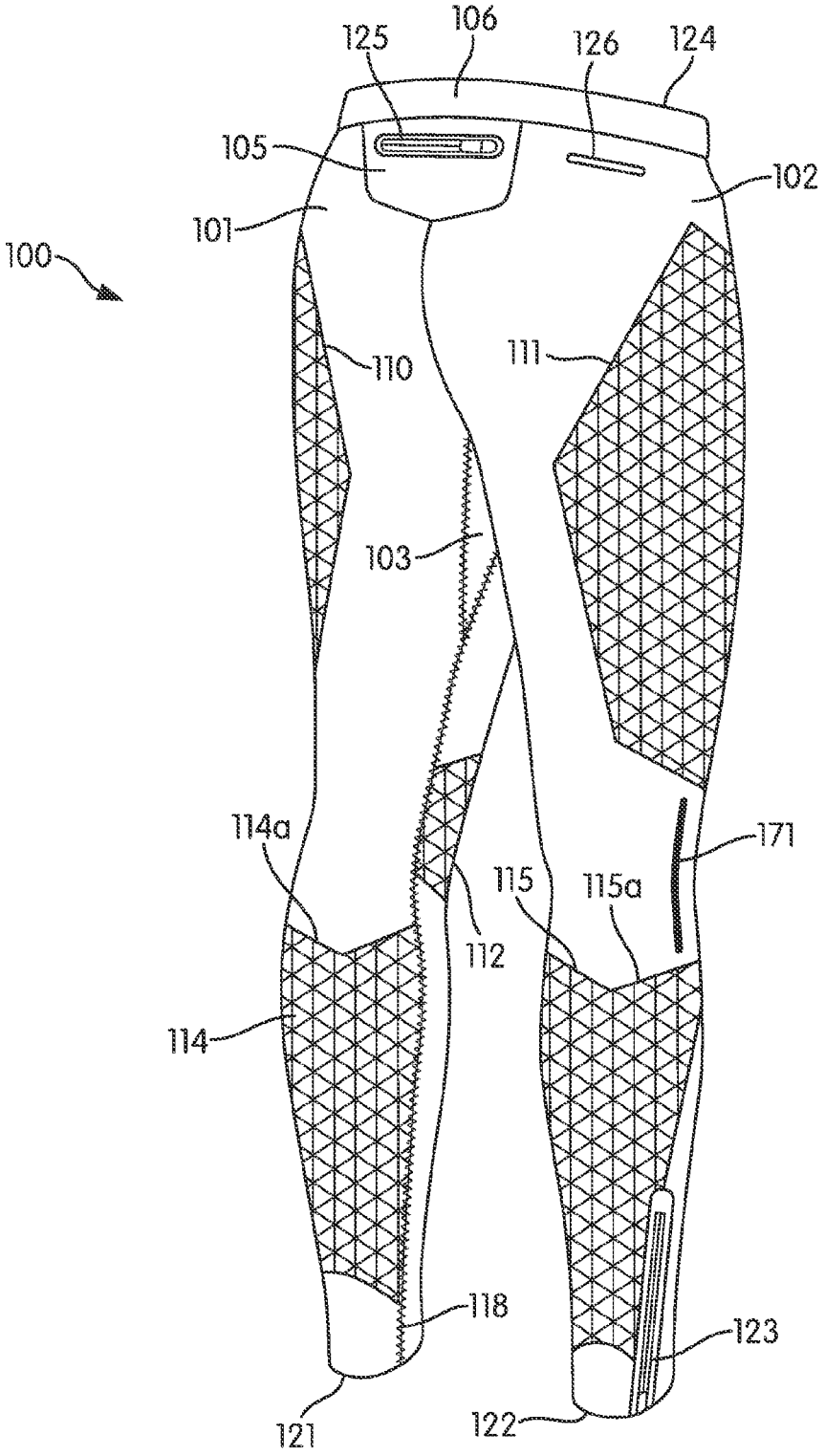

FIG. 1A is a front view of a garment 100 according to some embodiments. FIG. 1B is a rear view of garment 100. Garment 100, as indicated above, is configured for wear as a lower body garment and intended for use by a runner or jogger. In particular, garment 100 is a pair of "tights" configured for relatively tightly-fitting wear by a runner or jogger. As used herein, "configured for wear" refers to a garment being generally ready for wear by a person for whom the garment is properly sized. "Configured for wear" can contemplate some amount of adjustment or additional configuration such as opening or closing fasteners (zippers, VELCRO, snaps, etc.).

Garment 100 can be formed from various fabrics. Examples of fabrics that can be used include spandex and other stretchable synthetic materials. In some embodiments, the fabric is a blend of cotton, polyester and spandex fibers that includes hollow polyester fibers that wick moisture. Examples of such fabrics include fabrics sold under the name DRI-FIT by NIKE, Inc. of Beaverton, Oreg. Such fabrics move perspiration from the skin to the garment surface where the perspiration can evaporate quickly so as to help keep a wearer dry and comfortable. The spandex fibers within the material stretch to provide a comfortable, personalized fit.

Individual elements of garment 100 can be cut from larger sheets of stretchable fabric, and those elements can be assembled into garment 100 using any of various standard assembly techniques. As but one example, a first stretchable fabric element 101 can be used to form a left leg of garment 100. A second stretchable fabric element 102 can be used to form a right leg of garment 100. Another stretchable fabric element 103 can be used to form a crotch gusset of garment 100. An additional stretchable fabric element 104 can used to form a stomach panel of garment 100. Stretchable fabric element 105 can be used to form a rear panel/pocket of garment 100, with stretchable fabric element 106 used to form a waistband of garment 100. Elements 101-106 can be stitched or otherwise joined along adjoining boundaries in a customary manner. In other embodiments, more or fewer fabric elements could be used to create garment 100.

Unlike previously known lower body garments, garment 100 includes a plurality elasticity reducing panels 110 through 115. In particular, garment 100 includes a printed left thigh panel 110, a printed right thigh panel 111, a printed left knee panel 112, a printed right knee panel 113, a printed left calf panel 114 and a printed right calf panel 115. Each of panels 110 through 115 comprises a pattern that has been screen printed onto the fabric of garment 100 with a conventional silicone-based, non-PVC ink. The patterns of panels 110, 112 and 114 have been screen printed onto element 101, and the patterns of panels 111, 113 and 115 have been screen printed onto element 102, prior to assembly of elements 101 and 102 into garment 100.

After curing, the ink within patterns 110 through 115 reduces elasticity in the portions of the garment 100 fabric to which that cured ink is bonded. When garment 100 is worn, this reduced elasticity may help to provide support to and/or a feeling of support in the wearer muscle(s) underlying patterns 110 through 115.

The inside (medial) edges of left knee panel 112 and/or of left calf panel 114 may extend to or over left inseam 118 (FIG. 1B). Similarly, inside (medial) edges of right knee panel 113 and/or of right calf panel 115 may extend to or over right inseam 119 (FIG. 1A).

Garment 100 may include gripper elastic (not shown) in the ankle openings 121 and 122. Bonded zippers can also be included on the outside near the ankle openings. Although only bonded zipper 123 in the right rear is shown (FIG. 1B), a similar bonded zipper is present in a corresponding location on the left rear side. Garment 100 may further include a no-sew waistband 124 to reduce chafing and increase comfort. A reflective bonded zippered pocket 125 on the center back and a bonded drop-in pocket 126 on the back right hip provide secure storage for small items and remain visible in low light conditions. Garment 100 may include minimal seaming to reduce irritation from chafing. Additional reflective elements can be included at the waist and elsewhere on garment 100. Seams 170 and 171 can be included on lateral sides of knee panels 112 and 113, respectively, and can be stitched or otherwise bonded in place.

Figure 2A:
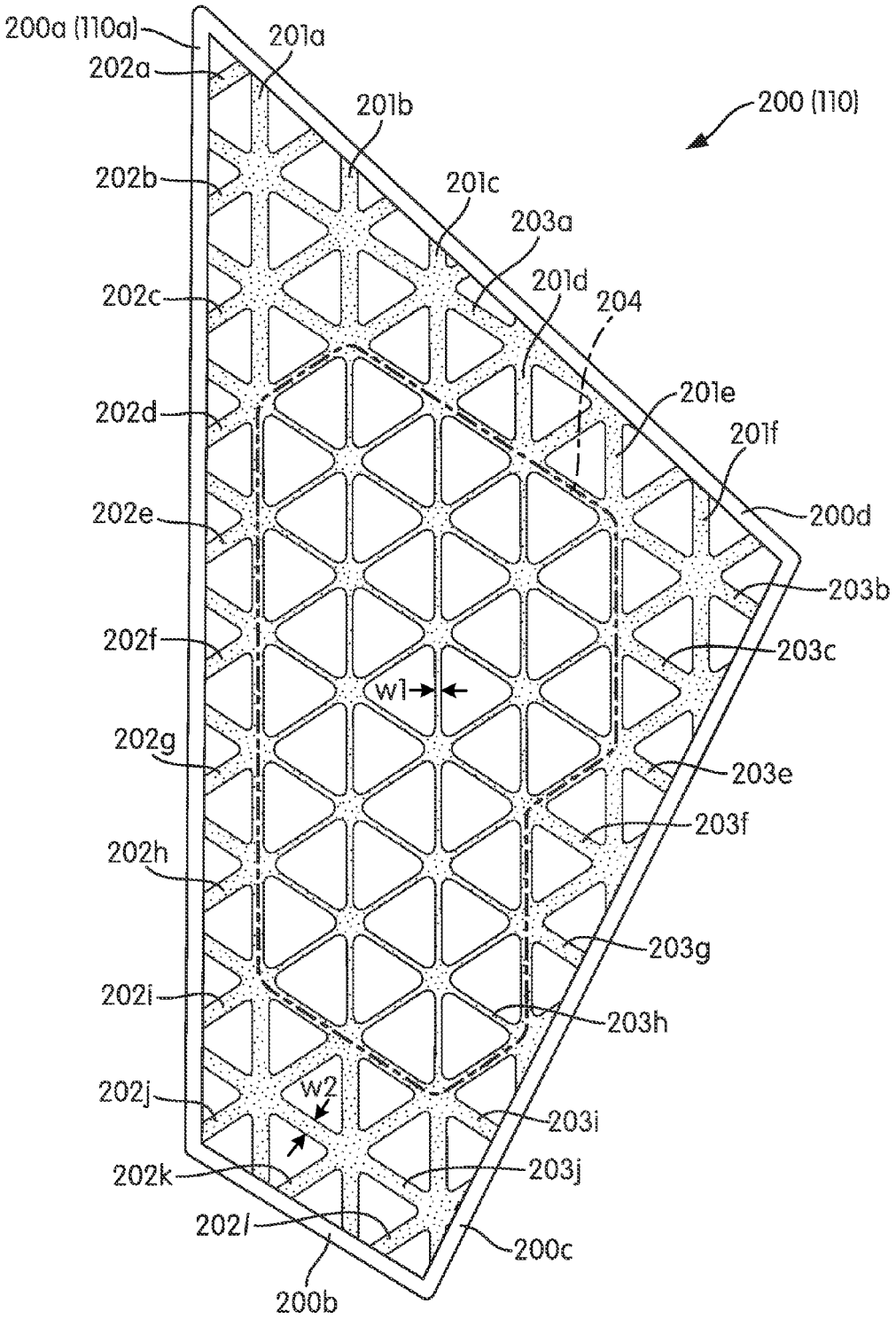
FIG. 2A shows a print pattern for a left thigh panel of the garment of FIGS. 1A and 1B.

FIG. 2A shows a pattern 200 used to create left thigh panel 110. In particular, pattern 200 is a pattern of ink that is screen imprinted onto fabric element 101, when element 101 is in a flattened condition, so as to create panel 110. So as to indicate the correspondence between pattern 200 and panel 110, reference number 110 is shown parenthetically after reference number 200 in FIG. 2A. A similar convention will be followed for individual components of panel 110 and pattern 200, as well as in connection with patterns (and corresponding panels) discussed in connection with FIGS. 2B through 4B.

Pattern 200 has four sides 200*a* through 200*d*. The longest side 200*a* corresponds to edge 110*a* of panel 110. The correspondence of sides 200*b* through 200*d* to the other edges of panel 110 can be deduced from the shapes of pattern 200 and panel 110.

Pattern 200 includes multiple intersecting lines within sides 200*a* through 200*d*. These lines form a mesh that extends throughout the space within the boundaries of sides 200*a* through 200*d*, while still exposing a substantial amount of interstitial space between the lines. That interstitial space will correspond to a substantial amount of exposed fabric in a corresponding panel.

In the orientation shown in FIG. 2A, the lines of pattern 200 include six vertical lines 201*a* through 201*f*, twelve inclining lines 202*a* through 202*l*, and nine declining lines 203*a* through 203*j*. Within an interior region 204, various line segments have thicknesses that are substantially reduced relative to thicknesses of line segments in peripheral regions of pattern 200 outside of region 204. For example, a segment of line 201*c* between the intersection of lines 201*c*, 202*g* and 203*e* and the intersection of lines 201*c*, 202*h* and 203*f* has a width w1. A segment of 203*j* between the intersection of lines 203*j*, 201*a* and 202*j* and the intersection of lines 203*j*, 201*b* and 202*k* has a width w2 that is more than twice that of w1.

As used herein (including the claims) when discussing patterns and corresponding elasticity reducing panels, "line" includes curves as well straight lines. In pattern 200, as well as in patterns described in connection with FIGS. 2B through 4B, the pattern lines are predominantly straight. In other embodiments, however, lines within a pattern or corresponding panel could be curved.

In some embodiments, and as is also seen in FIG. 2A, intersections of lines within a region of reduced line width can be broadened. Stated differently, additional ink can be added in the space where two narrowed line segments meet. This increased ink between adjacent lines at intersections and can reduce the risk of pattern separation at those intersections of narrowed segments once the ink has cured.

Figure 2B:
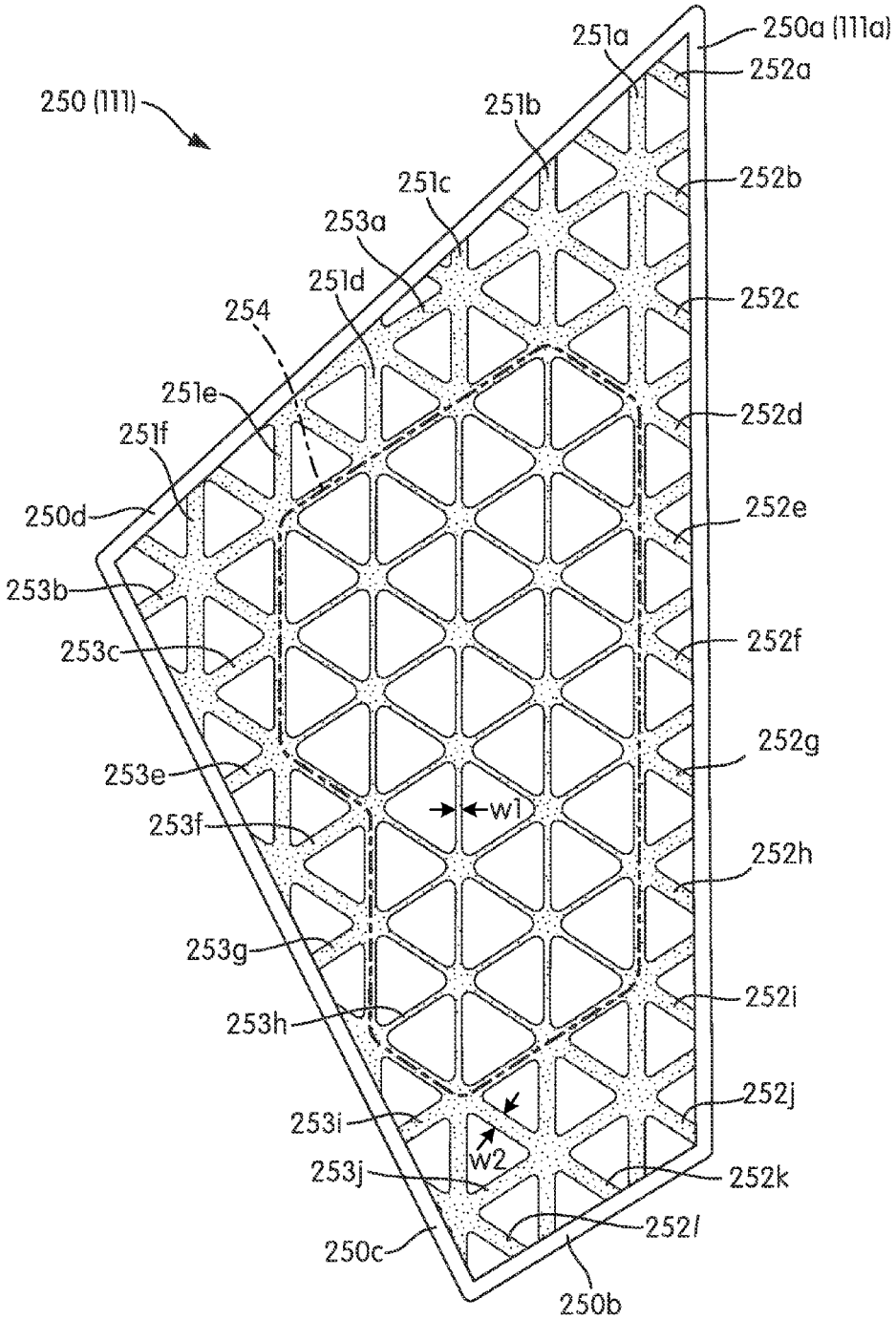
FIG. 2B shows a print pattern for a right thigh panel of the garment of FIGS. 1A and 1B.

FIG. 2B shows a pattern 250 of ink that is screen imprinted onto fabric element 102, when element 102 is in a flattened condition, so as to create right thigh panel 111. Pattern 250 is a mirror image of pattern 200 and has four sides 250*a* through 200*d*. The longest side 250*a* corresponds to edge 111*a* of panel 111. The correspondence of sides 250*b* through 250*d* to the other edges of panel 111 can be deduced from the shapes of pattern 250 and panel 111. In the orientation of pattern 250 depicted in FIG. 2B, the lines of pattern 250 include six vertical lines 251*a* through 251*f*, twelve declining lines 252*a* through 252*l*, and nine inclining lines 253*a* through 253*j*. Inside an interior region 254, portions of various lines have thicknesses that are substantially reduced relative to thicknesses of line portions in peripheral regions of pattern 250 outside of region 254. For example, the segment between the intersection of lines 251*c*, 252*k* and 253*i* and the intersection of lines 251*b*, 252*k* and 253*j* has a width w2 that is at least twice the width w1 of the segment between intersection of lines 251*c*, 252*h* and 253*f* and the intersection of lines 251*c*, 252*i* and 253*g*.

Figure 3A:
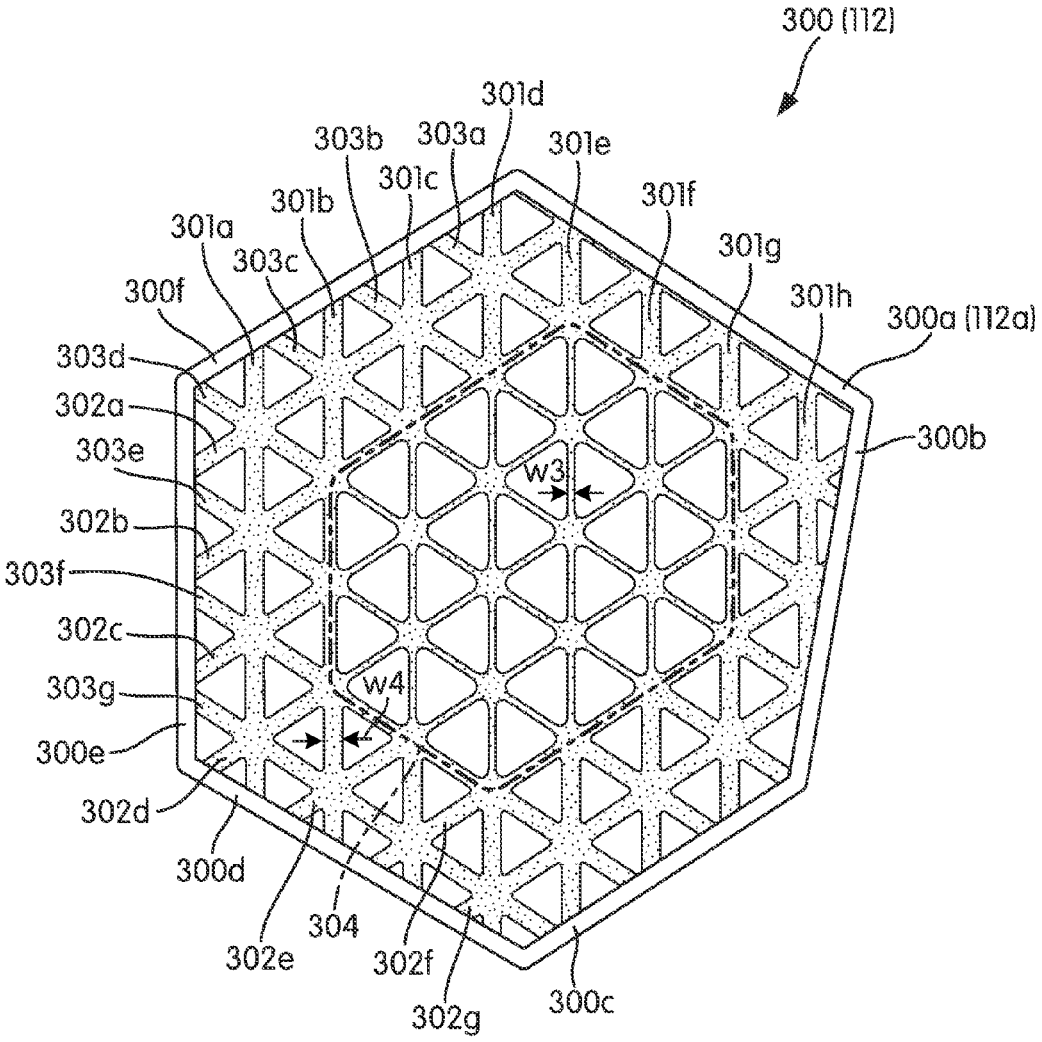
FIG. 3A shows a print pattern for a left knee panel of the garment of FIGS. 1A and 1B.

FIG. 3A shows a pattern 300 used to create left knee panel 112. In particular, pattern 300 is a pattern of ink that is screen imprinted onto fabric element 101, when element 101 is in a flattened condition, so as to create panel 112. Pattern 300 has six sides 300*a* through 300*f*. Side 300*a* corresponds to edge 112*a* of panel 112. The correspondence of sides 300*b* through 300*f* to the other edges of panel 112 can be deduced from the shapes of pattern 300 and panel 112.

Pattern 300 includes multiple intersecting lines within sides 300*a* through 300*f*. These lines form a mesh that extends throughout the space within the boundaries of sides 300*a* through 300*f*, while still exposing a substantial amount of interstitial space between the lines. In the orientation depicted in FIG. 3A, the pattern 300 lines include eight vertical lines 301*a* through 301*h*, seven inclining lines 302*a* through 302*g*, and seven declining lines 303*a* through 303*g*. Within an interior region 304, various line segments have thicknesses that are substantially reduced relative to thicknesses of line segments in peripheral regions of pattern 300 outside of region 304. For example, a segment of line 301*e* between the intersection of lines 301*e*, 302*c* and 303*b* and the intersection of lines 301*e*, 302*d* and 303*c* has a width w3. A segment of line 301*b* between the intersection of lines 301*b*, 302*d* and 303*f* and the intersection of lines 301*b*, 302*e* and 303*g* has a width w4 that is more than twice that of w3. Width w3 can (but need not) be the same as width w1 and width w4 can (but need not) be the same as width w2. Similar to pattern 200 of FIG. 2A, intersections within interior region 304 can be broadened.

Figure 3B:
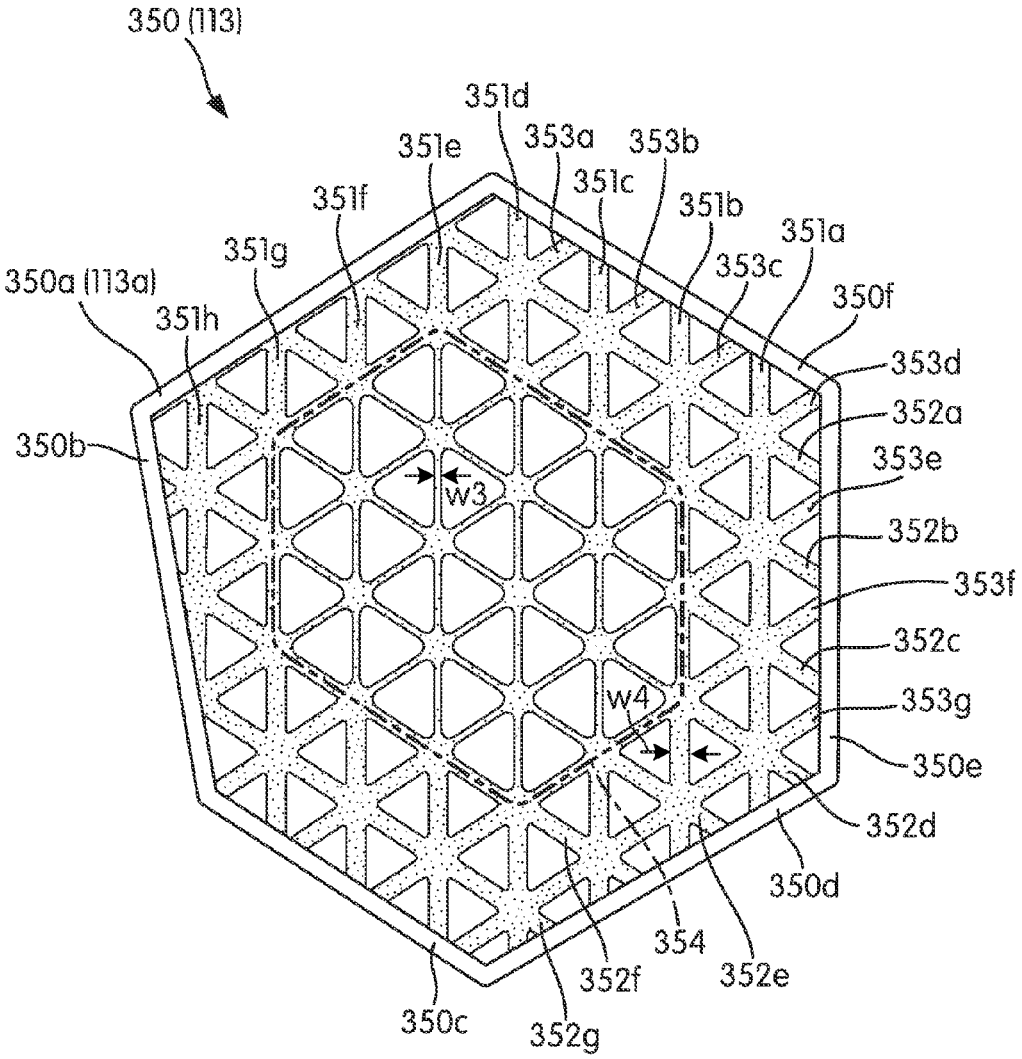
FIG. 3B shows a print pattern for a right knee panel of the garment of FIGS. 1A and 1B.

FIG. 3B shows a pattern 350 of ink that is screen imprinted onto fabric element 102, when element 102 is in a flattened condition, so as to create right knee panel 113. Pattern 350 is a mirror image of pattern 300 and has six sides 350*a* through 350*f*. Side 350*a* corresponds to edge 113*a* of panel 113. The correspondence of sides 350*b* through 350*f* to the other edges of panel 113 can be deduced from the shapes of pattern 350 and panel 113. In the orientation of pattern 350 shown in FIG. 3B, the lines of pattern 350 include six vertical lines 351*a* through 351*f*, seven declining lines 352*a* through 352*g*, and seven inclining lines 353*a* through 353*g*. Inside an interior region 354, portions of various lines have thicknesses that are substantially reduced relative to thicknesses of line portions in peripheral regions of pattern 350 outside of region 354. For example, the segment between the intersection of lines 351*b*, 352*d* and 353*f* and the intersection of lines 351*b*, 352*e* and 353*g* has a width w4 that is at least twice the width w3 of the segment between intersection of lines 351*e*, 352*c* and 353*b* and the intersection of lines 351*e*, 352*d* and 353*c*.

Figure 4A:
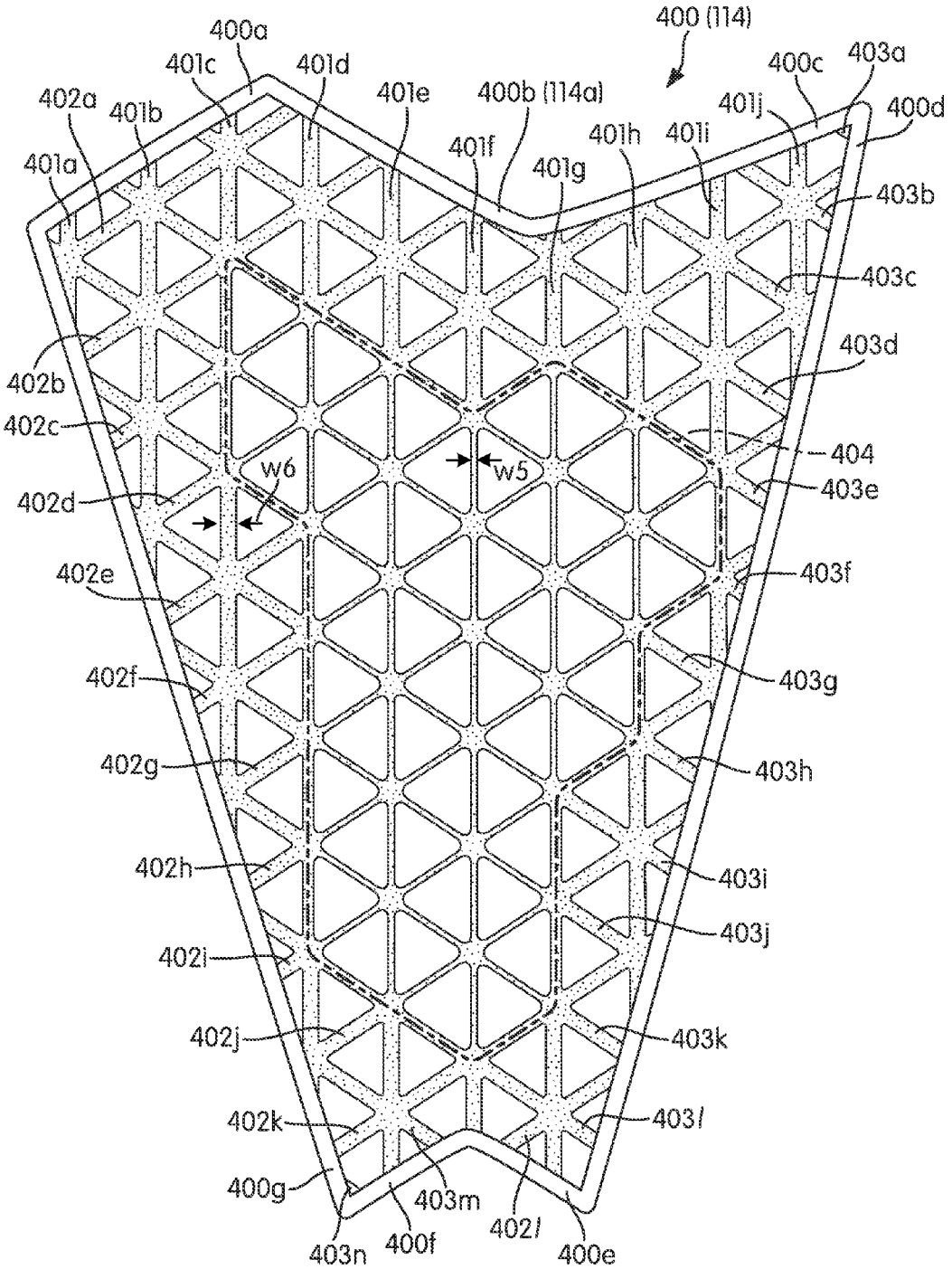
FIG. 4A shows a print pattern for a left calf panel of the garment of FIGS. 1A and 1B.

FIG. 4A shows a pattern 400 used to create left calf panel 114. In particular, pattern 400 is a pattern of ink that is screen imprinted onto fabric element 101, when element 101 is in a flattened condition, so as to create panel 114. Pattern 400 has seven sides 400*a* through 400*g*. Side 400*b* corresponds to edge 114*a* of panel 112. The correspondence of sides 400*a* and 400*c* through 400*g* to the other edges of panel 114 can be deduced from the shapes of pattern 400 and panel 114.

Pattern 400 includes multiple intersecting lines within sides 400*a* through 400*g*. These lines form a mesh that extends throughout the space within the boundaries of sides 400*a* through 400*g*, while still exposing a substantial amount of interstitial space between the lines. In the orientation depicted in FIG. 4A, the pattern 400 lines include ten vertical lines 401*a* through 401*j*, twelve inclining lines 402*a* through 402*l*, and fourteen declining lines 403*a* through 403*n*. Within an interior region 404, various line segments have thicknesses that are substantially reduced relative to thicknesses of line segments in peripheral regions of pattern 400 outside of region 404. For example, a segment of line 401*f* between the intersection of lines 401*f*, 402*e* and 403*f* and the intersection of lines 401*f*, 402*f* and 403*g* has a width w5. Width w5 may be the same or different than w1 and/or w3. A segment of line 401*c* between the intersection of lines 401*c*, 402*d* and 403*h* and the intersection of lines 401*c*, 402*e* and 403*i* has a width w6 that is more than twice that of w5. Width w6 may be the same or different than w2 and/or w4. Similar to pattern 200 of FIG. 2A and pattern 300 of FIG. 3A, intersections within interior region 404 can be broadened.

Figure 4B:
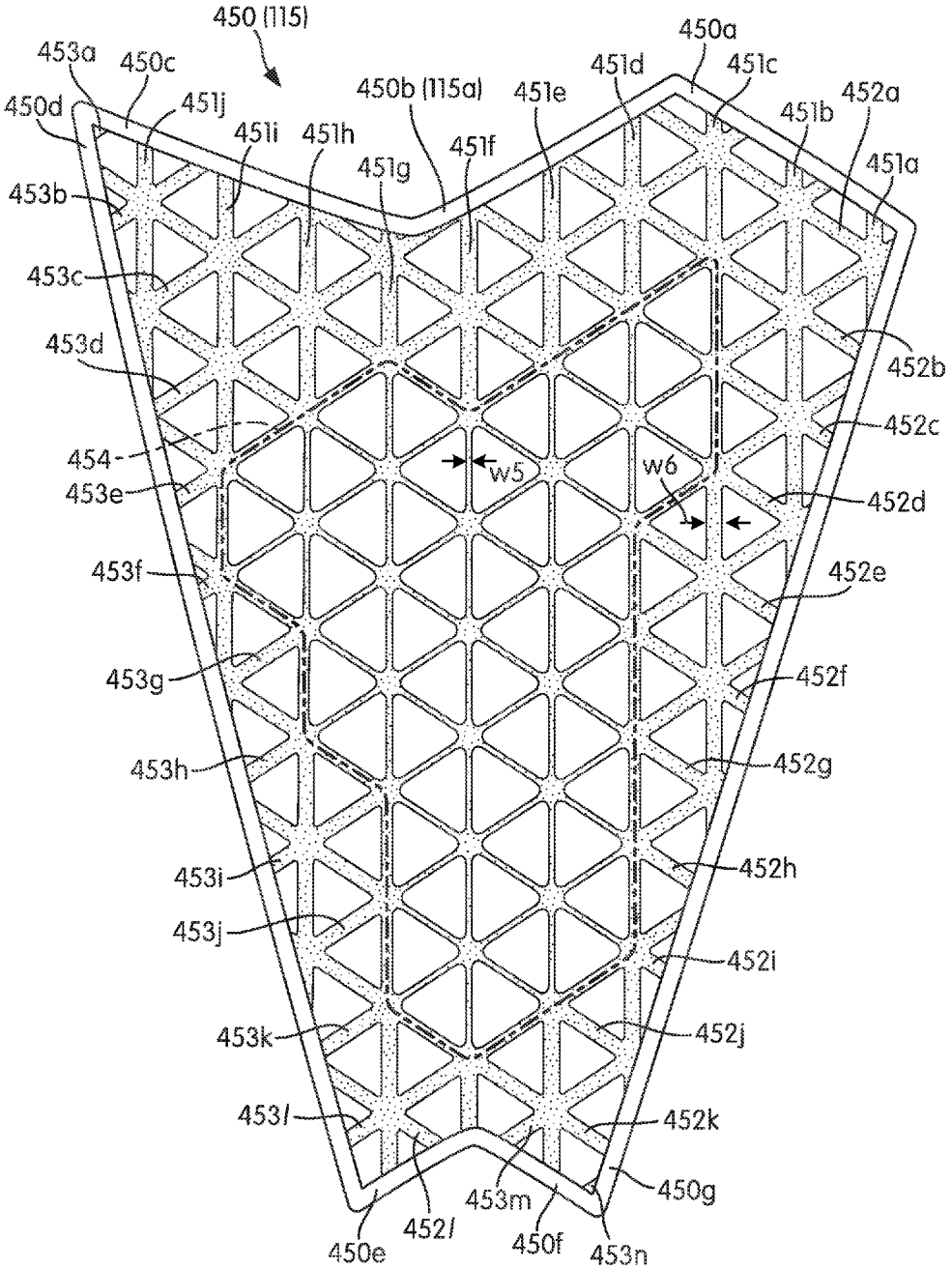
FIG. 4B shows a print pattern for a right calf panel of the garment of FIGS. 1A and 1B.

FIG. 4B shows a pattern 450 of ink that is screen imprinted onto fabric element 102, when element 102 is in a flattened condition, so as to create right calf panel 115. Pattern 450 is a mirror image of pattern 400 and has seven sides 450*a* through 450*g*. Side 450*b* corresponds to edge 115*a* of panel 115. The correspondence of sides 450*a* and 450*c* through 450*g* to the other edges of panel 115 can be deduced from the shapes of pattern 450 and panel 115. In the orientation of pattern 450 shown in FIG. 4B, the lines of pattern 450 include ten vertical lines 451*a* through 451*j*, twelve declining lines 452*a* through 452*l*, and fourteen inclining lines 453*a* through 453*n*. Inside an interior region 454, portions of various lines have thicknesses that are substantially reduced relative to thicknesses of line portions in peripheral regions of pattern 450 outside of region 454. For example, the segment between the intersection of lines 451*c*, 452*d* and 453*h* and the intersection of lines 451*c*, 452*e* and 453*i* has a width w6 that is at least twice the width w5 of the segment between intersection of lines 451*f*, 452*e* and 453*f* and the intersection of lines 451*f*, 452*f* and 453*g*.

In each of patterns 200, 250, 300, 350, 400 and 450, and as described above, the thicknesses of pattern lines in the interior regions (i.e., within regions 204, 254, 304, 354, 404, 454) is significantly less than the thicknesses of pattern lines in regions closer to the pattern periphery. As a result, each of panels 110, 111, 112, 113, 114 and 115 includes a region (corresponding to one of regions 204, 254, 304, 354, 404, 454) in which lines are thinner than in the periphery of the panel. This thin line/thick line combination may help to increase the support and/or feeling of support afforded by the panels.

In each of patterns 200, 250, 300, 350, 400 and 450, the lines are arranged so as to create equilateral triangles. In other embodiments, other patterns may be used, and other patterns may utilize other shapes and/or combinations of shapes. For example, a panel may comprise a pattern of overlapping circles and/or ovals, with the circles/ovals in an inner region of the pattern having thinner lines than the circles/ovals in regions of the pattern closer to the pattern periphery. Lines within a pattern need not be evenly distributed, e.g., some lines can be more closely spaced than others. The outer shape of a pattern can be varied from that of patterns 200, 250, 300, 350, 400 and 450.

Figure 5A:
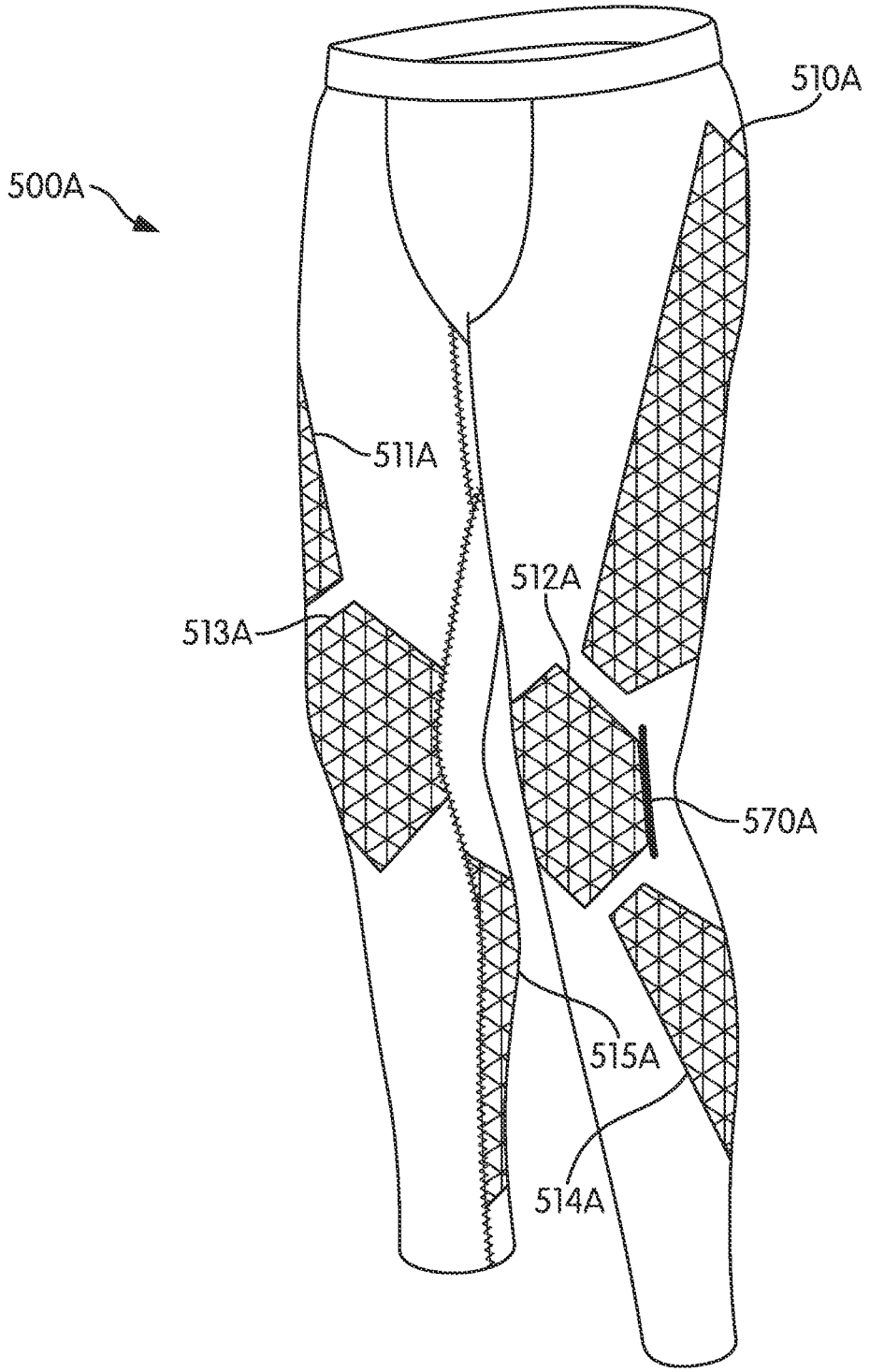
FIGS. 5A through 5D are front views of garments, similar to the garment of FIGS. 1A and 1B, according to additional embodiments.

FIG. 5A is a front view of a garment 500A according to another embodiment. Garment 500A is also configured for wear as a lower body garment and intended for use by a runner or jogger. Garment 500A is substantially the same as garment 100, is fabricated from the same type of fabric, and includes elasticity reducing panels 510A through 515A that are respectively identical to panels 110 through 115. Unlike garment 100, garment 500A includes a lateral outer seam 570A that extends along the lateral edge of printed left knee panel 512A. A similar lateral outer seam on the right side extends along the lateral edge of printed right knee panel 513A. Seam 570A and the corresponding lateral outer seam on the right side, which seams may be sewn and/or otherwise bonded to the fabric of garment 500A, may help to increase the support and/or feeling of support provided by panels 512A and 513A.

Figure 5B:
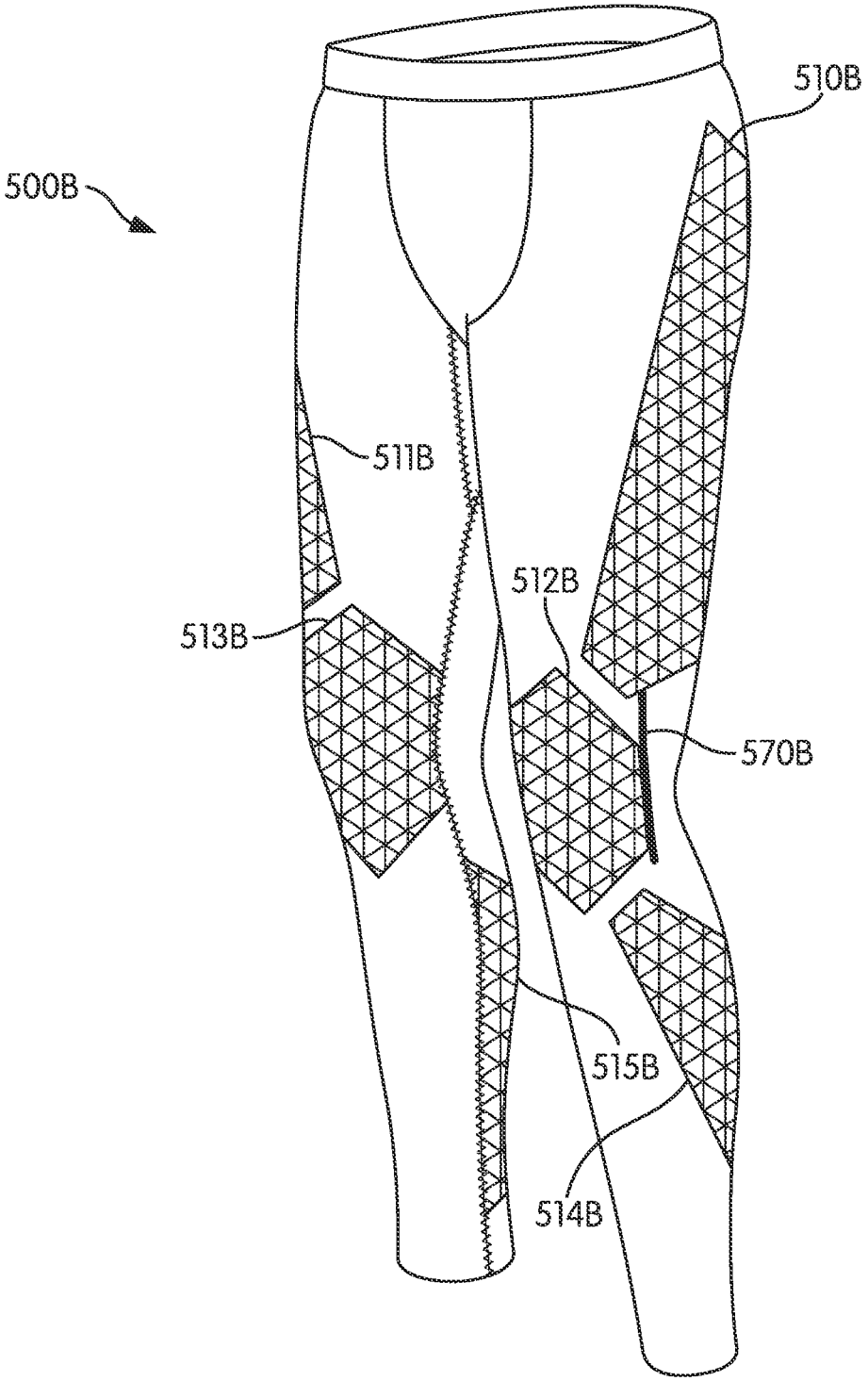

FIG. 5B is a front view of a garment 500B according to an additional embodiment. Garment 500B is substantially identical to garment 100, is fabricated from the same type of fabric, and includes elasticity reducing panels 510B through 515B that are respectively identical to panels 110 through 115. Garment 500B includes a lateral outer seam 570B that extends along the lateral edge of printed left knee panel 512B. Unlike seam 570A, seam 570B joins left knee panel 512B to the lower part of left thigh panel 511B. A similar lateral outer seam on the right side extends along the lateral edge of printed right knee panel 513B and joins right knee panel 513B to right thigh panel 511B. Seam 570B and the corresponding lateral outer seam on the right side of garment 500B, which seams may be sewn and/or otherwise bonded to the fabric of garment 500B, may help to increase the support and/or feeling of support provided by panels 512B and 513B and/or by panels 510B and 511B.

Figure 5C:
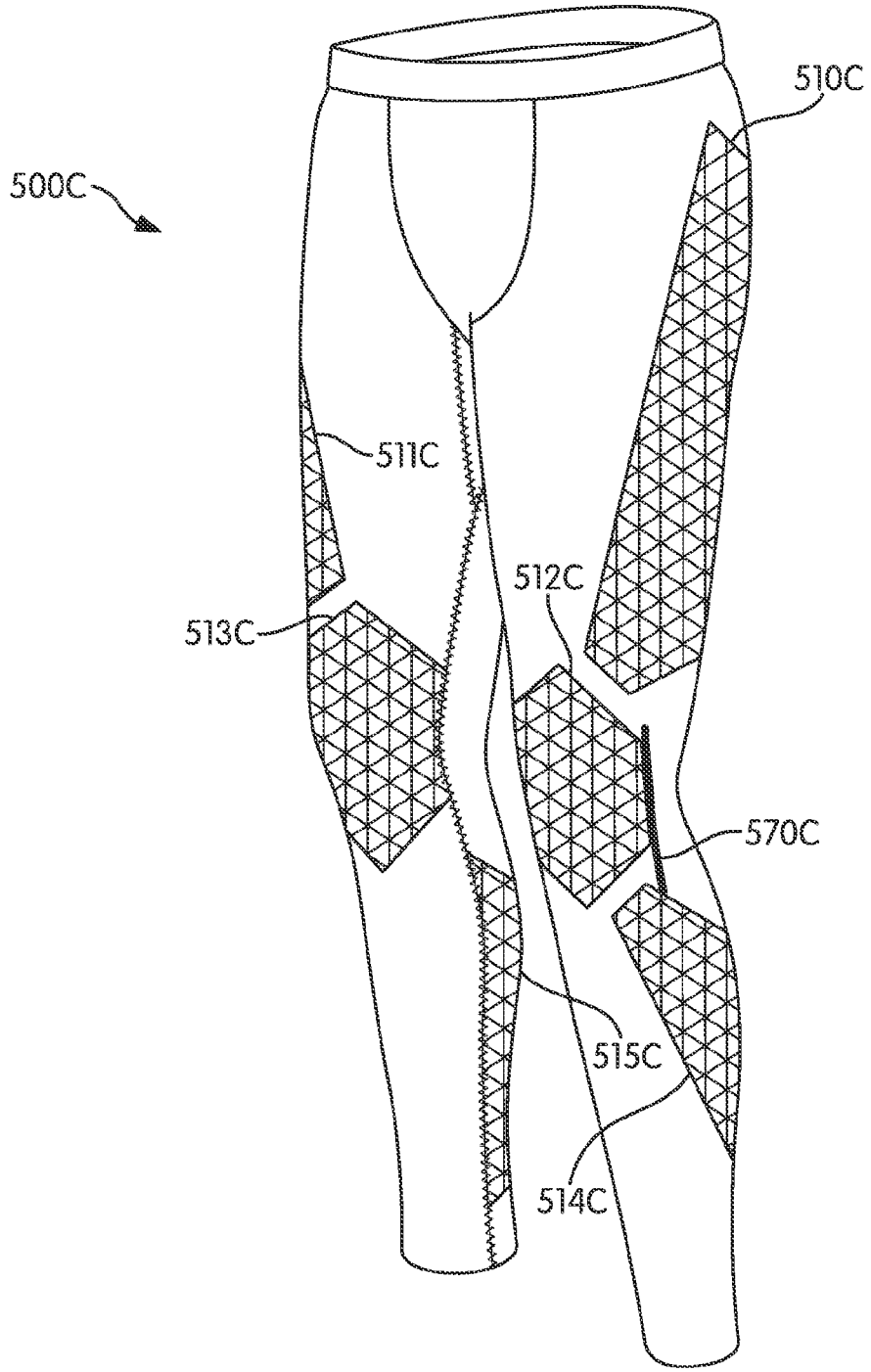

FIG. 5C is a front view of a garment 500C according to a further embodiment. Garment 500C is substantially identical to garment 100, is fabricated from the same type of fabric, and includes elasticity reducing panels 510C through 515C that are respectively identical to panels 110 through 115. Garment 500C includes a lateral outer seam 570C that extends along the lateral edge of printed left knee panel 512C. Unlike seams 570A and 570B, seam 570C joins left knee panel 512C to left calf panel 514C. A similar lateral outer seam on the right side extends along the lateral edge of printed right knee panel 513C and joins right knee panel 513C to right calf panel 515C. Seam 570C and the corresponding lateral outer seam on the right side of garment 500C, which seams may be sewn and/or otherwise bonded to the fabric of garment 500C, may help to increase the support and/or feeling of support provided by panels 512C and 513C and/or by panels 514C and 515C.

Figure 5D:
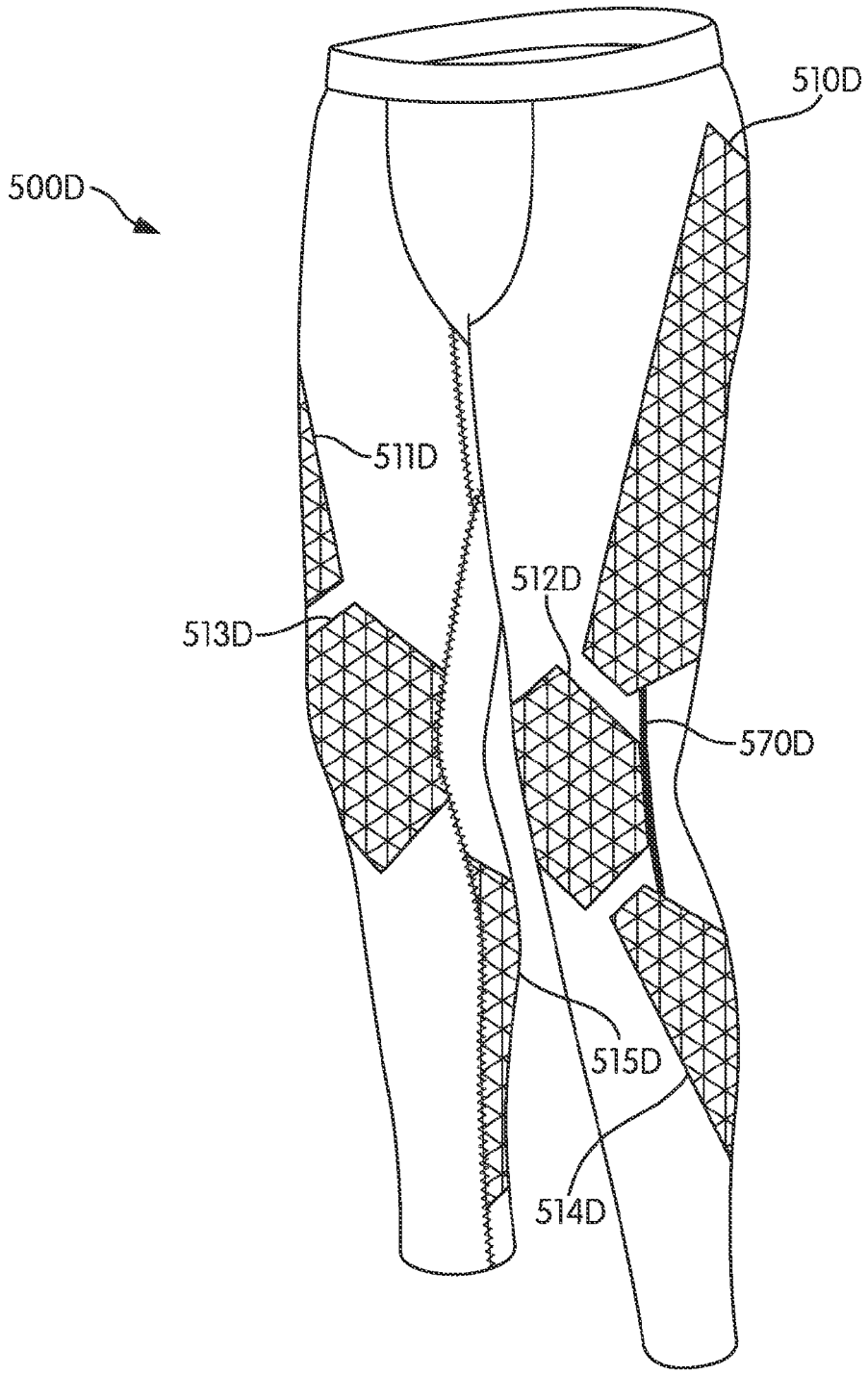

FIG. 5D is a front view of a garment 500D according to another embodiment. Garment 500D is substantially identical to garment 100, is fabricated from the same type of fabric, and includes elasticity reducing panels 510D through 515D that are respectively identical to panels 110 through 115. Garment 500D includes a lateral outer seam 570D that extends along the lateral edge of printed left knee panel 512D. Unlike seams 570A, 570B and 570C, seam 570D joins left knee panel 512D to the lower part of left thigh panel 510D and to left calf panel 514D. A similar lateral outer seam on the right side of garment 500D extends along the lateral edge of printed right knee panel 513D and joins right knee panel 513D to right thigh panel 511D and to right calf panel 515D. Seam 570D and the corresponding lateral outer seam on the right side of garment 500D, which seams may be sewn and/or otherwise bonded to the fabric of garment 500D, may help to increase the support and/or feeling of support provided by panels 512D and 513D, and/or by panels 510D and 511D, and/or by panels 514D and 515D.

Figure 6A:
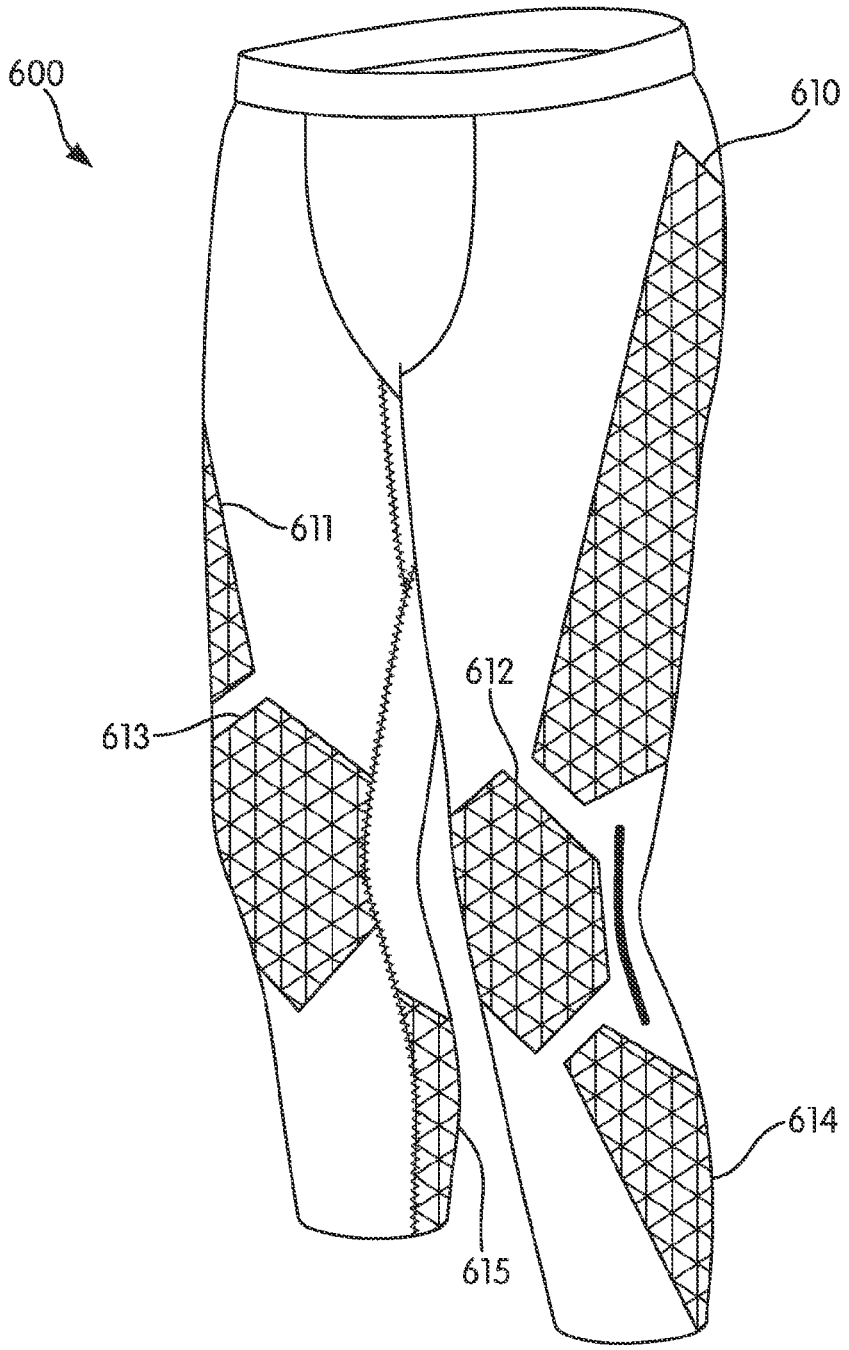
FIGS. 6A and 6B are front and rear views, respectively, of a garment according to another embodiment.
Figure 6B:
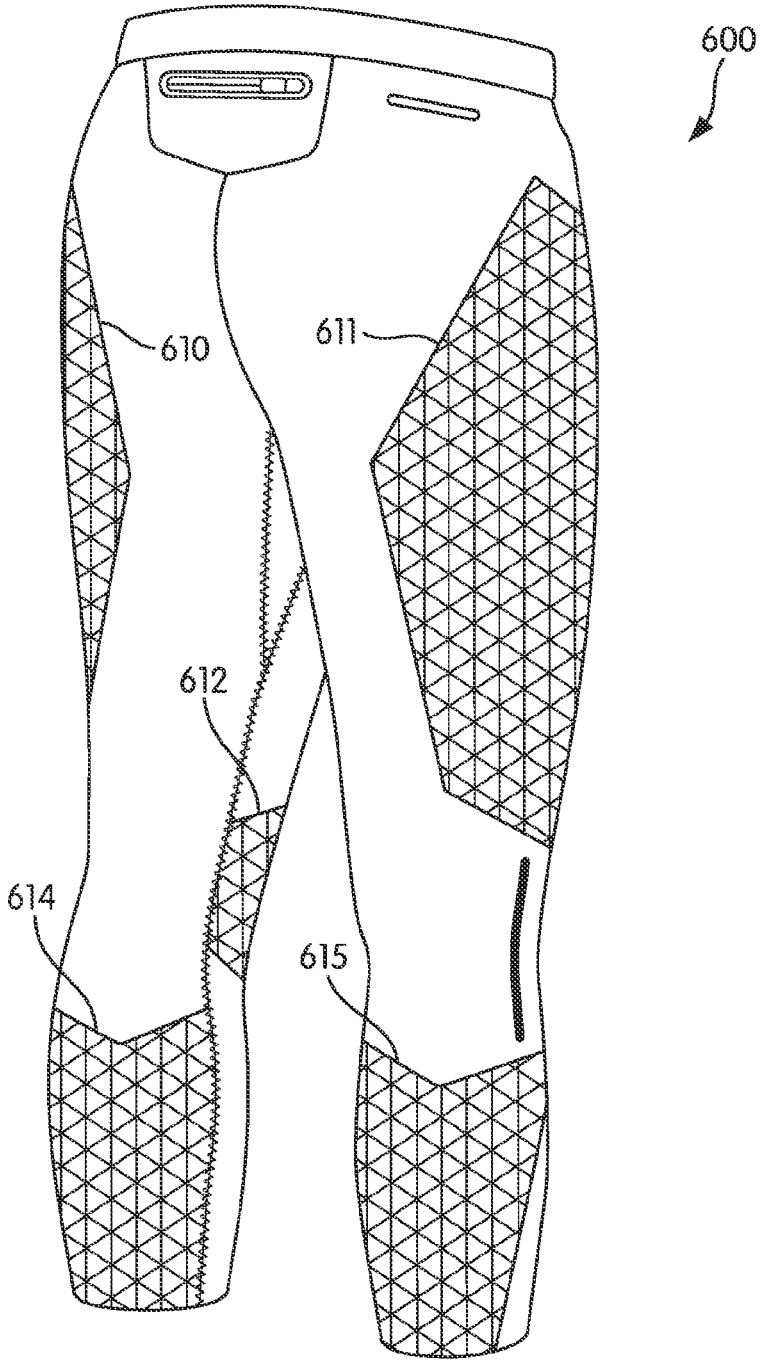

FIGS. 6A and 6B show front and rear views, respectively of a garment 600 according to a further embodiment. Garment 600 is a "Capri" version of garment 100. In particular, garment 600 is also configured for wear as a lower body garment and intended for use by a runner or jogger. Garment 600 is fabricated from the same type of fabric as garment 100. Garment 600 includes elasticity reducing left thigh panel 610 and right thigh panel 611 that are respectively identical to panels 110 and 111 of garment 100. Garment 600 similarly includes elasticity reducing left knee panel 612 and elasticity reducing right knee panel 613 that are respectively identical to panels 112 and 113 of garment 100.

Garment 600 differs from garment 100 based on the length of the legs. Specifically, the lengths of the legs of garment 600 are shorter. As a result, elasticity reducing left calf panel 614 of garment 600 is a truncated version of elasticity reducing right calf panel 114 of garment 100. Similarly, elasticity reducing right calf panel 615 of garment 600 is a truncated version of elasticity reducing right calf panel 115 of garment 100. Additional embodiments include "Capri" versions incorporating seams such as, e.g., seams 570A, 570B, 570C or 570D.

Figure 7A:
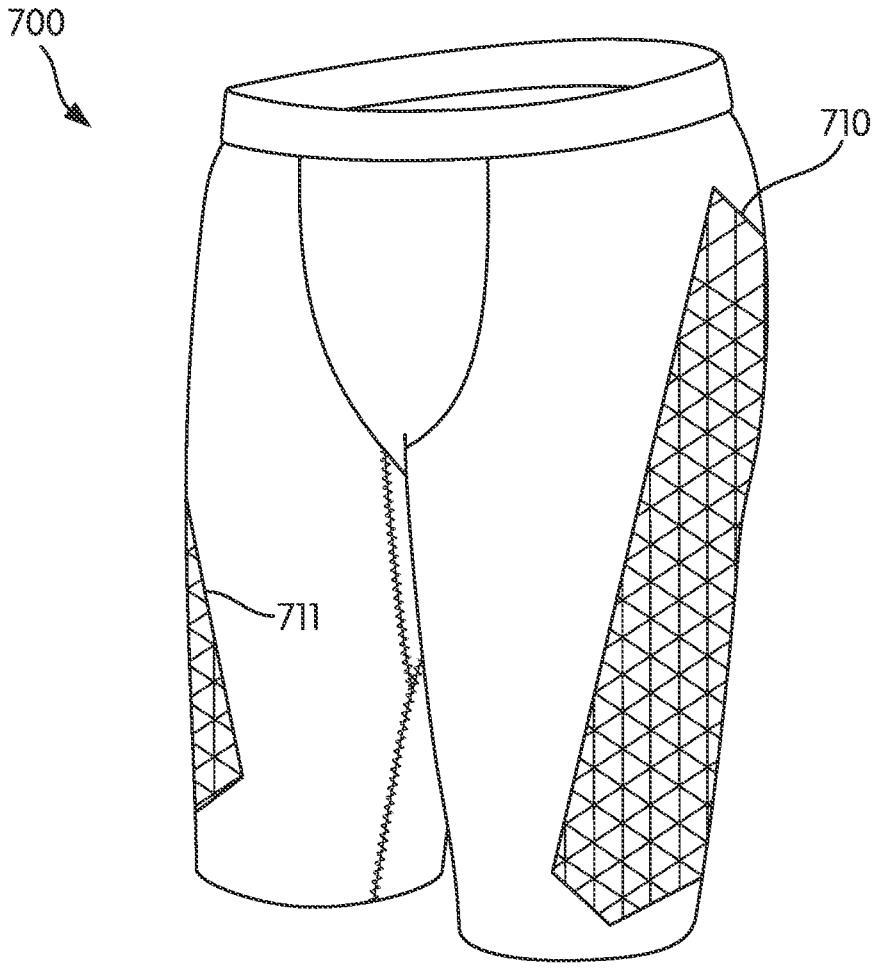
FIGS. 7A and 7B are front and rear views, respectively, of a garment according to an additional embodiment.
Figure 7B:
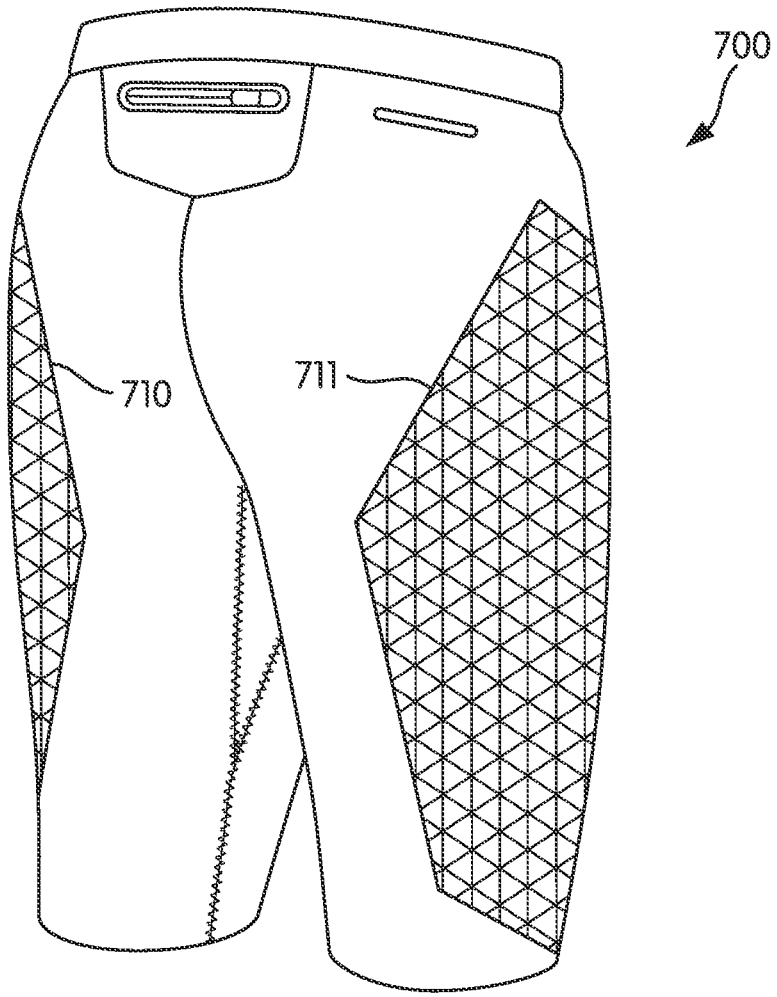

FIGS. 7A and 7B show front and rear views, respectively of a garment 700 according to another embodiment. Garment 700 is a shorts version of garment 100. In particular, garment 700 is also configured for wear as a lower body garment and intended for use by a runner or jogger. Garment 700 is fabricated from the same type of fabric as garment 100. Garment 700 includes elasticity reducing left thigh panel 710 and right thigh panel 711 that are respectively identical to panels 110 and 111 of garment 100. Garment 700 is similar to garment 100 and other embodiments described thus far, except that the legs of garment 700 terminate above the knees. Accordingly, there are no knee or calf panels. Seams similar to, e.g., seam 570B and a corresponding right side seam could be added and connected to the bottoms of thigh panels 710 and 711.

Although various embodiments are described in connection with garments intended for wear by runners or joggers, other embodiments include garments intended for wear during other activities. Moreover, the invention is not limited to lower body garments, and may include garments that are also (or exclusively) configured for upper body wear. The invention is not limited to the shape, pattern or placement of elasticity reducing panels described. Other embodiments include garments in which elasticity reducing panels have different patterns, shapes and/or locations. A garment need not include an elasticity reducing thigh panel. For example, a lower body garment according to some embodiments may only include elasticity reducing panels in the knee and/or calf regions.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, subcombinations and permutations of features from above-described embodiments are the within the scope of the invention. With regard to claims directed to an apparatus, an article of manufacture or some other physical component or combination of components, a reference in the claim to a potential or intended wearer or a user of a component does not require actual wearing or using of the component or the presence of the wearer or user as part of the claimed component or component combination.

The invention claimed is:

1. A garment, comprising: at least one stretchable fabric element, wherein the garment is a lower body garment configured for wear by an individual and comprises right and left legs;

a first elasticity-reducing panel comprising a first pattern imprinted onto a first portion of the at least one stretchable fabric element in a lateral thigh region of the right leg and extending from a right front thigh region to a right rear thigh region, wherein the first pattern comprises a plurality of intersecting first pattern lines forming a mesh completely bounded by first pattern edges and is confined to above-knee portions of the right leg, portions of the first pattern lines in peripheral regions having thicknesses that are at least twice as great as thicknesses of the portions of the first pattern lines in an interior region, and the first pattern is completely surrounded by, and an entire length of an outermost portion of each of the first pattern edges is directly adjacent to, a second portion of the at least one stretchable fabric element lacking an elasticity reducing panel; and a second elasticity-reducing panel comprising a second pattern imprinted onto a third portion of the at least one stretchable fabric element in a lateral thigh region of the left leg and extending from a left front thigh region to a left rear thigh region, wherein the second pattern comprises a plurality of intersecting second pattern lines forming a mesh completely bounded by second pattern edges and is confined to above-knee portions of the left leg, portions of the second pattern lines in peripheral regions having thicknesses that are at least twice as great as thicknesses of the portions of the second pattern lines in an interior region, and the second pattern is completely surrounded by, and an entire length of an outermost portion of each of the second pattern edges is directly adjacent to, a fourth portion of the at least one stretchable fabric element lacking an elasticity reducing panel;

further comprising:

third and fourth elasticity-reducing panels, wherein the third elasticity-reducing panel comprises a third pattern imprinted onto a knee region of the right leg, the fourth elasticity-reducing panel comprises a fourth pattern imprinted onto a knee region of the left leg, the third pattern comprises third pattern lines, portions of the third pattern lines in an interior region of the third pattern have thicknesses less than thicknesses of portions of the third pattern lines in peripheral regions of the third pattern, and the fourth pattern is a mirror image of the third pattern; and a first lateral outer seam extending along a lateral outer edge of the third elasticity-reducing panel; and a second lateral outer seam extending along a lateral outer edge of the fourth elasticity-reducing panel.

2. The garment of claim 1, further comprising fifth and sixth elasticity-reducing panels, wherein the fifth elasticity-reducing panel comprises a fifth pattern imprinted onto a calf region of the right leg, the fifth pattern not extending above the knee region of the right leg, the sixth elasticity-reducing panel comprises a sixth pattern imprinted onto a calf region of the left leg, the sixth pattern not extending above the knee region of the left leg , the fifth pattern comprises fifth pattern lines, portions of the fifth pattern lines in an interior region of the fifth pattern have thicknesses less than thicknesses of portions of the fifth pattern lines in peripheral regions of the fifth pattern, and the sixth pattern is a mirror image of the fifth pattern.

3. The garment of claim 2, further comprising:

a first lateral outer seam extending along a lateral outer edge of the third elasticity-reducing panel and connecting the third elasticity-reducing panel to the fifth elasticity-reducing panel; and a second lateral outer seam extending along a lateral outer edge of the fourth elasticity-reducing panel and connecting the fourth elasticity-reducing panel to the sixth elasticity-reducing panel.

4. A garment, comprising:

a stretch fabric lower body garment, the lower body garment comprising a plurality of elasticity-reducing panels, and wherein the elasticity-reducing panels include first and second elasticity-reducing panels respectively located in right lateral thigh and left lateral thigh regions of the garment and completely surrounded by stretch fabric portions lacking elasticity reducing panels, the first elasticity-reducing panel extending from a right front thigh region to a right rear thigh region and the second elasticity-reducing panel extending from a left front thigh region to a left rear thigh region, each of the panels comprises a plurality of edges defining boundaries of the panel and a plurality of intersecting cross-panel ink lines imprinted onto the stretch fabric to form a mesh, each cross-panel ink line of the plurality extending across the panel within a region defined by the boundaries, in each panel of the plurality, portions of the cross-panel ink lines adjacent to the boundaries of the panel have thicknesses at least twice as great as thicknesses of portions of the cross-panel ink lines between cross-panel ink line intersections in an interior portion of the panel, and each of the panels exposes a substantial portion of the stretch fabric within the boundaries of the panel; and wherein at least a portion of the elasticity- reducing panels are located in knee regions of the garment; and further comprising: a first lateral outer seam extending along a lateral outer edge of an elasticity- reducing panel located in a right knee region; and a second lateral outer seam extending along a lateral outer edge of an elasticity- reducing panel located in a left knee region.

5. The garment of claim 4, wherein at least a portion of the elasticity-reducing panels are located in calf regions of the garment.

6. The garment of claim 5, further comprising:

a first lateral outer seam extending along a lateral outer edge of an elasticity-reducing panel located in a right knee region and connecting the elasticity-reducing panel located in the right knee region to an elasticity-reducing panel located in a right calf region; and a second lateral outer seam extending along a lateral outer edge of an elasticity-reducing panel located in a left knee region and connecting the elasticity-reducing panel located in the left knee region to an elasticity-reducing panel located in a left calf region.

7. The garment of claim 1, wherein the third pattern lines extend across and are confined within boundaries of the third pattern.

8. The garment of claim 2, wherein the third pattern lines extend across and are confined within boundaries of the third pattern, and the fifth pattern lines extend across and are confined within boundaries of the fifth pattern.

9. The garment of claim 4, wherein the first elasticity-reducing panel does not circumscribe the right leg and does not extend below a knee region of the right leg, and the second elasticity-reducing panel does not circumscribe the left leg and does not extend below a knee region of the left leg.

10. The garment of claim 5, wherein the first elasticity-reducing panel does not circumscribe the right leg and does not extend below a knee region of the right leg, the second elasticity-reducing panel does not circumscribe the left leg and does not extend below a knee region of the left leg, the at least a portion of the elasticity-reducing panels located in calf regions comprises a right calf panel on the right leg and a left calf panel on the left leg, the right calf panel does not circumscribe the right leg and does not extend above the knee region of the right leg, and the left calf panel does not circumscribe the left leg and does not extend above the knee region of the left leg.

11. The garment of claim 1, wherein the at least one stretchable fabric element comprises multiple stretchable fabric elements joined along adjoining fabric element boundaries to form the lower leg garment, and the first elasticity-reducing panel comprises a first pattern imprinted onto a single one of the stretchable fabric elements.

* * * * *